US008702282B2

(12) United States Patent
Birkholz et al.

(10) Patent No.: US 8,702,282 B2
(45) Date of Patent: Apr. 22, 2014

(54) LIGHT SIGNAL

(75) Inventors: Joerg Birkholz, Drasdo (DE); Rolf Eckl, Berlin (DE); Uwe Frost, Berlin (DE); Kay Koester, Fredersdorf (DE); Zeljko Marincic, Berlin (DE); Norbert Poepplow, Eichwalde (DE)

(73) Assignee: Siemens Aktiengesellschaft, Munich (DE)

( * ) Notice: Subject to any disclaimer, the term of this patent is extended or adjusted under 35 U.S.C. 154(b) by 115 days.

(21) Appl. No.: 13/393,286

(22) PCT Filed: Jul. 27, 2010

(86) PCT No.: PCT/EP2010/060887
§ 371 (c)(1),
(2), (4) Date: Feb. 29, 2012

(87) PCT Pub. No.: WO2011/023480
PCT Pub. Date: Mar. 3, 2011

(65) Prior Publication Data

US 2012/0153314 A1 Jun. 21, 2012

(30) Foreign Application Priority Data

Aug. 31, 2009 (DE) ..... 10 2009 039 703

(51) Int. Cl.
*F21V 17/02* (2006.01)

(52) U.S. Cl.
USPC ..... 362/322; 362/244

(58) Field of Classification Search
USPC ..... 362/244, 322; 257/40–99
See application file for complete search history.

(56) References Cited

U.S. PATENT DOCUMENTS

| | | | | |
|---|---|---|---|---|
| 4,430,659 | A | 2/1984 | Maffitt et al. | |
| 4,754,272 | A | 6/1988 | Illenberg et al. | |
| 5,697,584 | A | 12/1997 | Chew | |
| 7,553,044 | B2 | 6/2009 | Wedell | |
| 2004/0001139 | A1 * | 1/2004 | Kobayashi | 348/59 |
| 2005/0058450 | A1 * | 3/2005 | Yamamoto et al. | 398/25 |
| 2005/0122719 | A1 * | 6/2005 | Liebscher et al. | 362/257 |
| 2006/0002114 | A1 * | 1/2006 | Sun | 362/257 |
| 2007/0024863 | A1 * | 2/2007 | Kadowaki et al. | 356/498 |
| 2007/0236927 | A1 * | 10/2007 | Liu | 362/228 |

FOREIGN PATENT DOCUMENTS

| | | | |
|---|---|---|---|
| CN | 2340659 | Y | 9/1999 |
| CN | 201066539 | Y | 5/2008 |
| DE | 202 10 321 | U1 | 11/2003 |
| EP | 1 860 368 | A2 | 11/2007 |

* cited by examiner

*Primary Examiner* — Telly Green
(74) *Attorney, Agent, or Firm* — Laurence A. Greenberg; Werner H. Stemer; Ralph E. Locher

(57) ABSTRACT

A light signal contains a semiconductor light source and a convex lens system for representing signal aspects, especially on rail-bound traffic routes. In order to eliminate the need for monochrome semiconductor light sources, the semiconductor light source is a white point light source. A signal aspect-specific color filter is provided in the aperture region of the point light source.

4 Claims, 2 Drawing Sheets

LIGHT SIGNAL

BACKGROUND OF THE INVENTION

Field of the Invention

The invention relates to a light signal comprising a semiconductor light source and a converging optical unit for representing signal aspects, in particular on rail-bound traffic routes.

The explanations below substantially relate to luminous signs or light signals for representing signal aspects on rail-bound traffic routes, without the claimed inventive subject matter being intended to be restricted to this application.

In the case of the four light signals of known design as illustrated schematically in FIG. 1, either an incandescent filament arrangement of an incandescent lamp 1 or a semiconductor light source 2 is used as the light source. The incandescent filament light signal substantially consists of the incandescent lamp 1 and an optical system comprising a full lens 3 or stepped lens 4 and a color filter glass 5 for realizing the customary signal colors, in particular red, green and amber. In the case of the semiconductor light sources 2 illustrated on the right in FIG. 1, for example LEDs—light emitting diodes—, the light is generated by electrical excitation of a semiconductor. Semiconductor light sources 2 have a completely different emission characteristic than incandescent lamps 1, such that generally the complete optical system has to be replaced by an LED-specific lens matrix 6. LEDs 7 already provided with lens optical units are also used for specific structural sizes. Said LEDs 7, and LEDs 7.1 without optical units, have to be embodied as monochrome LEDs having narrow color locus limits, in order to permanently generate the signal-specific light color in a reliable manner. In addition to color locus fidelity, it is also necessary to achieve a minimum axial light intensity. Furthermore, the necessary availability, the stock keeping of a plurality of LED types and the manufacturer dependence thereof are problematic in the case of monochrome LEDs 7, 7.1. Moreover, the LED energization for the same brightness is color-dependent, such that signal transmitters with different driver assemblies are required. Consequently, the safety verifications for signal transmitters are highly complex.

BRIEF SUMMARY OF THE INVENTION

The invention is based on the object of simplifying a light signal of the generic type, wherein, in particular, the type diversity of the required semiconductor light sources is to be reduced.

According to the invention, the object is achieved by virtue of the fact that the semiconductor light source is embodied as a white point light source, wherein a signal-aspect-specific color filter is provided in the aperture region of the point light source.

As a result of the reduction to point light sources of the white light type, monochrome semiconductor light sources become dispensable. Besides the independence of individual manufacturers, this results in a significant cost reduction as a result of component reduction in the driver assemblies. The expected uniform lifetime of the white point light source is also advantageous, whereas monochrome semiconductor light sources have very different lifetimes depending on the required energization for achieving the minimum axial light intensity.

In principle, it should be expected that in the future the achievable luminous efficiency in the case of point light sources, in particular on the basis of HLED for white light, will increase further. This means that even more powerful white HLEDs used in the future can be energized in a reduced fashion for the same light intensity, whereby the lifetime of the HLEDs increases.

In accordance with one embodiment, each signal aspect is assigned a point light source comprising a white LED or a white HLED—high-current LED. Depending on the signal aspect, a corresponding color filter is fixedly arranged between the point light source and the converging optical unit.

In the case of light signals designed for a plurality of signal aspects, a component and structural size reduction can be achieved by virtue of the fact that, in accordance with another embodiment, the signal aspects are assigned a common point light source comprising a white LED or a white HLED and a common converging optical unit, wherein an automatic changer for positioning signal-aspect-specific color filters in the aperture region of the point light source is provided.

Preferably, in accordance with one embodiment, the color filter is embodied as a polycarbonate color filter film. These very cost-effective color films are used very often in the field of photography. Moreover, polycarbonate color filter films exhibit particularly high thermal stability and long-term stability, wherein individual color films or a plurality of color films combined with one another, in the use of the HLED white light source, can generate approximately any desired color locus in the emission. In this case, the filter films to be used are only dependent on the spectral composition of the axial light component and can be very precisely determined and optimized in accordance with the spectral properties of the filter films. In this case, the transmittance of the color filter films is comparable to the transmittance of corresponding color glass sheets used in the case of incandescent lamp light sources.

The invention is explained in greater detail below with reference to illustrations in figures, in which:

DESCRIPTION OF THE INVENTION

Figure 1:
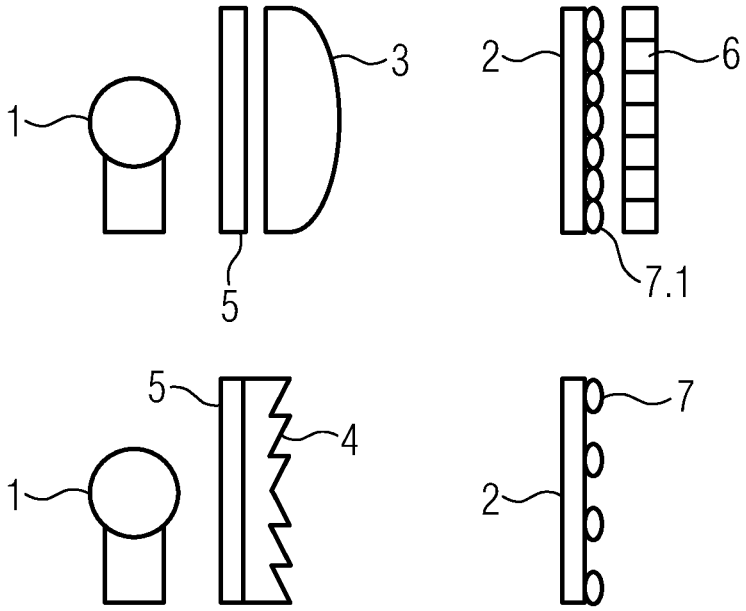
FIG. 1 PRIOR ART
FIG. 1 shows light signals of known design.
Figure 2:
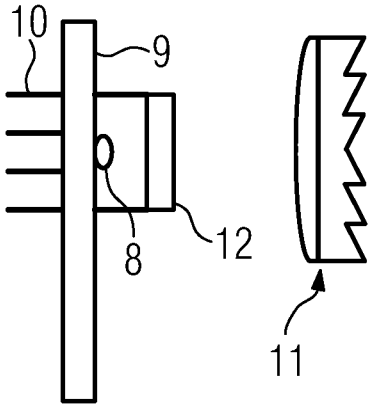
FIG. 2 shows a light signal of a claimed design.

In contrast to the four light signals described above and illustrated in FIG. 1, a single white LED—high-current LED—8 is used as a point light source in the case of the light signal according to the invention as illustrated in FIG. 2. Said HLED is arranged on a circuit board 9 with a heat sink 10. In order to realize different signal colors, a color filter film arrangement 12 is provided between the HLED and a converging optical unit 11.

Figure 3:
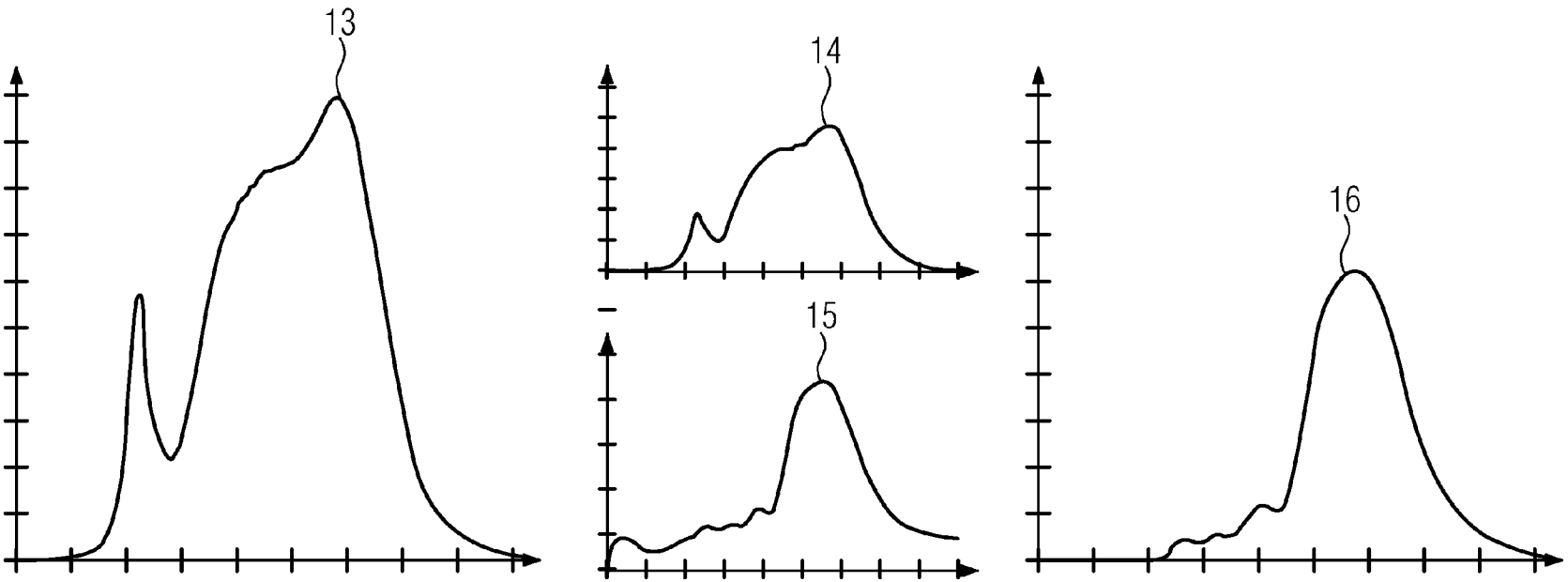
FIG. 3 shows a spectral light distribution for generating a yellow color locus.

FIG. 3 shows on the left an emission spectrum 13 of the white HLED 8. Said HLED 8 is combined with the color filter film arrangement 12, which consists of two color filter films having the transmission spectra 14 and 15. It is evident that the resultant total spectrum 16 has a high transmittance for the color locus yellow, such that a yellow luminous light signal arises.

The invention claimed is:

1. A light signal, comprising:

a semiconductor light source being a white point light source defining an aperture region;

a converging optical unit for defining signal properties, said converging optical unit being a common converging optical unit assigned to the signal properties;

at least one signal-aspect-specific color filter disposed in said aperture region of said white point light source, said signal-aspect-specific color filter being a polycarbonate color filter film;

an automatic changer for positioning said signal-aspect-specific color filter into the aperture region of said white point light source; and said white point light source being a common point light source and the signal properties are assigned said common point light source, said common point light source having a light emitting diode (LED) selected from the group consisting of a white LED and a white, high-current LED.

2. The light signal according to claim 1, wherein said white point light source is one of a plurality of white point light sources each containing a light emitting diode (LED) selected from the group consisting of a white LED and a white, high-current LED, each of the signal properties is assigned one of said white point light sources.

3. The light signal according to claim 1, wherein the light signal is configured for used on rail-bound traffic routes.

4. A light signal, comprising:

a semiconductor light source being a white point light source defining an aperture region;

a converging optical unit for defining signal properties, said converging optical unit being a common converging optical unit assigned to the signal properties;

at least one signal-aspect-specific color filter disposed in said aperture region of said white point light source, said signal-aspect-specific color filter being a polycarbonate color filter film;

an automatic changer for positioning said signal-aspect-specific color filter into the aperture region of said white point light source; and said white point light source having only a single light emitting diode (LED) selected from the group consisting of a single white LED and a single white, high-current LED.

* * * * *